United States Patent [19]

Genovese et al.

[11] Patent Number: 4,794,254

[45] Date of Patent: Dec. 27, 1988

[54] DISTRIBUTED RESISTANCE CORONA CHARGING DEVICE

[75] Inventors: Frank C. Genovese; Robert W. Anderson, both of Fairport, N.Y.

[73] Assignee: Xerox Corporation, Stamford, Conn.

[21] Appl. No.: 55,663

[22] Filed: May 28, 1987

[51] Int. Cl.[4] ..... H01T 19/04

[52] U.S. Cl. ..... 250/324; 346/155; 346/159; 250/326

[58] Field of Search ..... 250/324, 325, 326; 361/225, 229; 346/155, 159

[56] References Cited

U.S. PATENT DOCUMENTS

| | | | |
|---|---|---|---|
| 3,875,320 | 4/1975 | Forgo et al. | 346/155 |
| 4,158,848 | 6/1979 | Ishima | 346/155 |
| 4,356,501 | 10/1982 | Romen | 346/155 |
| 4,426,654 | 1/1984 | Tarumi et al. | 250/326 |
| 4,652,318 | 3/1987 | Masuda et al. | 250/324 |

*Primary Examiner*—Bruce C. Anderson

[57] ABSTRACT

A distributed resistance corona generating device includes an insulating substrate, a resistive material layer deposited on the substrate to a uniform thickness, and a plasma gap separating the resistive material layer into at least two resistive material regions. A voltage is applied to the resistive material regions through electrodes arranged on the resistive material regions so that a uniform resistance is provided between the power supply and the points on the resistive material regions immediately adjacent to the plasma gap. The distributed resistance corona generating device is inherently self regulating to provide a uniform charging potential along the plasma gap.

20 Claims, 4 Drawing Sheets

DISTRIBUTED RESISTANCE CORONA CHARGING DEVICE

The present invention relates generally to corona charging devices for use in electrostatographic applications and more particularly to a self regulating distributed resistance driven corona generating device.

BACKGROUND OF THE INVENTION

In electrostatographic applications such as xerography, a charge retentive surface is electrostatically charged, and exposed to a light pattern of an original image to be reproduced to selectively discharge the surface in accordance therewith. The remaining pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. The process is well known, and is useful for light lens copying from an original, and printing applications from electronically generated or stored originals. The process has analogs in other electrostatographic applications such as, for example, ionographic applications, where charge is deposited on a charge retentive surface in accordance with an image stored in an electronic form.

It is common practice in electrophotography and its analogs to use wire corona generating devices to provide electrostatic fields driving various machine operations. Thus, corona devices are used to deposit charge on the charge retentive surface prior to exposure to light, to implement toner transfer from the charge retentive surface to the substrate, to neutralize charge on the substrate for removal from the charge retentive surface, and to clean the charge retentive surface after toner has been transferred to the substrate. These corona devices normally incorporate at least one fine wire coronode held at a high voltage to generate ions or charging current to charge a surface closely adjacent to the device to a uniform voltage potential, and may contain screens and other auxiliary coronodes to regulate the charging current or control the uniformity of charge deposited. The devices may be driven with positive or negative D.C. potentials.

Dicorotrons are A.C. driven corona devices incorporating a dielectric coating over the active coronode structure, to provide an arrangement which has the characteristics of an array of capacitors coupled to the air between the voltage source and the charge retentive surface, blocking D.C. current flow from the coronode to the charge retentive surface. The charging current to the charge retentive surface at any point on the coronode surface is limited by the maximum displacement current that can be delivered by the dielectric, which provides an essentially self regulating device. Applying a large A.C. potential to the coronode creates a gaseous plasma at the coronode that is maintained by the displacement current at any point. If the plasma current exceeds the displacement current at any point along the coronode, such as in the case of a non-uniformity caused by dust or debris on the coronode, the plasma potential drops and the plasma current is quenched at that point. If the plasma current is too low, the plasma potential rises and the plasma current is forced to increase. As a result of this action, the overall discharge from the coronode to the surface tends to be uniform since each point on the coronode surface delivers the same net charge per unit area to the plasma as every other point during each voltage reversal. The current extracted from the plasma to charge the charge retentive surface is therefore uniform and the device tends to be stable because of its self regulating behavior. By contrast, D.C. driven bare wire devices such as corotrons have a tendency to arc at non-uniformities along the coronode which, in effect, causes each point along the coronode to compete for current at the expense of adjacent areas. Thus, non-uniformity has an effect of reducing the available corona current along the entire coronode. This effect has a tendency to be more pronounced in negative charging devices.

Because of the problems, inherent in the use of suspended coronode charging devices, a significant amount of work had been done to provide charging devices without such a requirement. Among these are U.S. Pat. No. 4,057,723 to Sarid et al., which shows a dicorotron having a dielectric coated coronode uniformly supported along its length on the shield or an insulating substrate. U.S. Pat. No. 4,409,604 to Fotland teaches support for a cylindrical, dielectric coated coronode in an insulating support. U.S. Pat. No. 4,155,093 to Fotland et al. shows the use of two electrodes separated by a dielectric, in combination with a conductive support with a dielectric coating to receive extracted ions. Published Japanese Patent Application No. 58-48073 to Momotake, teaches a charging device for selectively charging portions of the image area of a photoreceptor, having rectangular discharging electrodes supported on a glass insulator. U.S. Pat. No. 4,430,661 to Tarumi et al teaches an ion modulation arrangement which modulates the direction of ion flow directed therethrough from a wire corotron device.

SUMMARY OF THE INVENTION

In accordance with the invention, a distributed resistance corona device is provided with a layer of resistive material uniformly deposited on an insulating substrate, and connected to a relatively high voltage source. A corona is created by the device at a plasma gap extending through the resistive material layer and separating the material into two separate resistive material regions on the substrate. Each region is connected to one of either the high or low potential side of the power supply. The device, in comparison to a dicorotron, has the circuit characteristics of a resistor array coupled to air between the voltage source and the charge retentive surface, or a distributed resistance. The inventive distributed resistance corona device is self regulating in nature, such that as an arc starts at any point along the coronode surface, characterized by a greater current at that point, the voltage across the resistive region to that point has a tendency to increase, which in turn lowers the plasma current. The excess voltage drop at any point along the coronode is minimized at neighboring points on the coronode surface because of a decoupling action of the resistance, even though all points are fed from a common voltage. Each point along the coronode acts as a high impedance current source delivering a fixed current to the local plasma. The corona is maintained along the plasma gap for charging, while the point arcing problem is eliminated. This is not the same as providing a resistor in the supply line of a normal wire coronode device, but, in effect, provides a resistor along every point of the coronode surface.

The solid nature of the inventive distributed resistance corona device also provides significant mechanical advantages over other corona devices. The inventive corona device is mechanically stable and relatively rugged in comparison to wire coronode charging devices. Because there is no wire coronode involved, the problems associated with vibration and sagging exhibited in wire coronodes are alleviated. No fragile glass coated wires subject to breakage, as required by dicorotrons, are necessary. The distributed resistance corona device may be driven with either positive or negative voltage signals, at lower voltage levels.

In accordance with one aspect of the invention, the distributed resistance corona device is supported on a generally planar insulating substrate member, with a layer of resistive material uniformly deposited on a single surface thereof. A narrow plasma gap is provided in the resistive material, separating the resistive material into at least two regions coextensive with the plasma gap on the substrate. Electrode members connect each resistive material region to the high or low potential of a power supply in a manner providing a uniform resistance between the electrode and the plasma gap. The power supply, preferably a D.C. voltage source, may provide either a positive or negative polarity across the device. Provisions may be made on the resistive material regions to provide a dielectric material overcoating, which aids in controlling the direction of the electric field directed from one resistive region to the the other. In this manner, ions generated at the plasma gap may be prevented from returning to the dielectric covered resistive regions, thereby increasing the number of ions which are actually passed to the charge retentive surface. The dielectric layer may also serve as a support for control electrodes to modulate or direct the ion flow to the surface to be charged.

In accordance with yet another aspect of the invention, the distributed resistance corona device may be arranged in a folded or knife edge configuration. Accordingly, the insulating substrate has first and second opposed sides connected by a connecting surface or substrate edge, with resistive material on either side of the substrate and the plasma gap along the connecting surface separating the resistive material on the two sides of the substrate. Each resistive material region is connected to a power supply to generate ions at the plasma gap. The advantage of the folded or knife edge configuration is that the electric field, and accordingly, ions generated at the plasma gap, are directed from a resistive material region in the direction towards which ion distribution is desired before redirection toward the the other resistive material layer, thereby increasing the number of ions which are actually passed to the charge retentive surface. This arrangement may also benefit from a dielectric overcoating on portions of the resistive material layer for the control of the direction of the electric field or support of control electrodes.

In accordance with still another aspect of the invention, an arrangement is provided which provides portions of the resistive material to be segmented and controllably driven to produce differing charging characteristics at the plasma gap. One of the resistive material regions may be segmented into separate segments, each segment contiguous to the plasma gap and connected to a separate driving voltage for control of the plasma gap portion adjacent to that segment. The close proximity to the surface to be charged to the novel distributed resistance corona device provides the areas charged by each segment with relatively sharp boundaries. The charged area may be defined so that edge erase lamps or interdocument lamps normally used in electrophotographic devices are unnecessary. Alternatively, a low resolution annotator may be provided by driving a number of small segments in accordance with annotating information.

These and other aspects of the invention will become apparent from the following description used to illustrate a preferred embodiment of the invention read in conjunction with the accompanying drawings in which.

Figure 1:
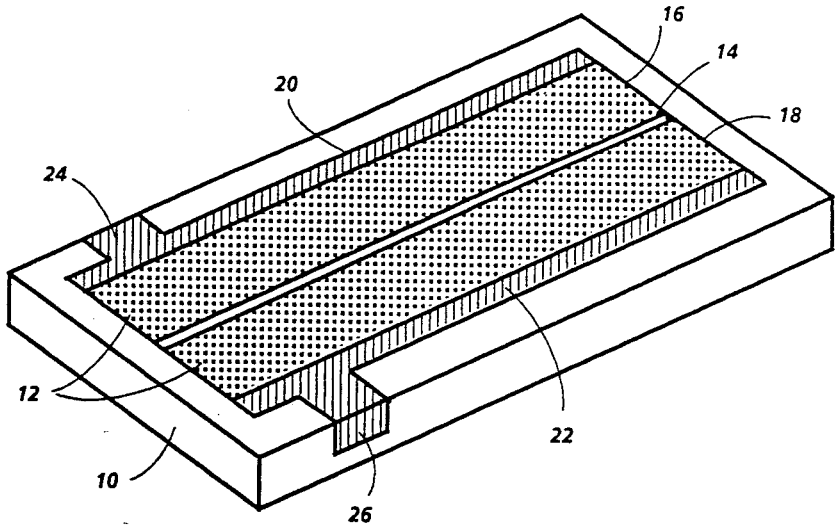
FIG. 1 is a perspective view of a distributed resistance corona generating device in accordance with the invention.
Figure 2:
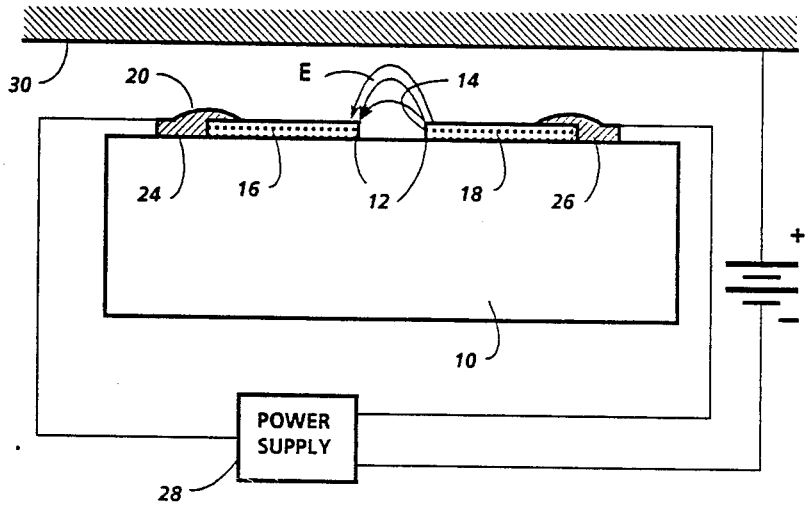
FIG. 2 is a cross sectional view of the distributed resistance corona generating device.

Referring now to the drawings where the showings are for the purpose of describing a preferred embodiment of the invention and not for the purpose of limiting same, FIGS. 1 and 2 show a distributed resistance corona generating device in accordance with the invention. An insulating substrate 10 comprising a planar member of glass or a glass-like material such as alumina, is coated with a thin layer of a resistive material 12. As the distributed resistance corona generating device is intended as a substitute for a wire coronode charging device, the operable portion of the device has a length which corresponds to the width of a surface to be charged. The width of the device is variable with the needs for placement in a system, and to economically manufacture the device. In a preferred embodiment, the resistive material may be a thick film resistive paint or ink approximately 1 mil in thickness which is kiln hardenable at 500°-850° C. to a glassy or ceramic finish, resistant to most abrading or casual cutting contact. Satisfactory materials are available from the DuPont Corporation, Wilmington, Del., under the trademark BIROX having a resistance on the order of approximately 100 megohms per square at the described thickness. Resistive materials suitable for use range in resistivity from 1-1000 megohms per square. In the simplest case, the materials may be painted onto the substrate, although, as uniformity of the resistive material is an important factor in the uniform output of the device, sputtering of thin film resistive coating materials onto the substrate is believed to produce the most uniform layer.

A plasma gap 14 is formed in the resistive material layer 12 to the depth of substrate 10, separating the resistive material layers into two distinct regions 16 and 18, coextensive with the gap. A suitable gap may preferably range in thickness from approximately 2–10 mils, with the smaller gap sizes requiring lower driving voltages and producing greater output uniformity, although gap thicknesses from 0.5 to 20 mils may be useful. The gap may be formed in the resistive layer with is deposition on the substrate or subsequently cut through the material. The cut gap, best seen in FIG. 4, may extend somewhat into insulating substrate 10 to allow the plasma to form away from the insulating surface, thereby reducing plasma quenching by the cold substrate walls, with the trade off that the device may be more difficult to simply wipe clean. With reference again to FIGS. 1 and 2, conducting electrodes 20 and 22 extend along the length of each resistive material regions 16 and 18, and are connected respectively through contact tabs 24 and 26 the high and low potential side of power supply 28 to uniformly provide a voltage signal to each point along the plasma gap. The resistance between power supply 28 and plasma gap 14 should be the same for each point on the electrode surface adjacent the plasma gap for the purpose of charging uniformity. To improve uniformity, the resistance from the power supply to the the plasma gap may be varied by adding a conductive paint extending from the electrodes 20 and 22 across a portion of the resistive material region, whereby a portion of the resistive region is short circuited, and the resistance is reduced. Other methods of trimming the resistive material layers to obtain uniform resistance across the regions are certainly possible. A D.C. source operating in the range of greater than 1.5 kilovolts is preferred for use in powering the device, although an A.C. source may potentially be used. However, the applied A.C. source is partially attenuated by parasitic capacitances in the device, and is not preferred. Additionally, the device may be provided with multiple plasma gaps, which act as parallel devices, to increase current and reduce irregularities in charging uniformity by statistical averaging.

In use, and with reference to FIG. 2, the distributed resistance corona generating device may be supported for charging less than about 25 mils from a surface to be charged, with the plasma gap exposed to the surface to be charged. A charge retentive surface 30 is held at a charge polarity opposite to the desired charging polarity, such as by applying a precharge or by biasing the surface to a selected voltage prior to charging.

The corona threshold voltage of the distributed resistance corona generating device is somewhat lower than for typical wire devices, in the range of about 900 volts. The described device characteristics produce a plasma current in the range of 1–25 microamps.

Figure 3A:
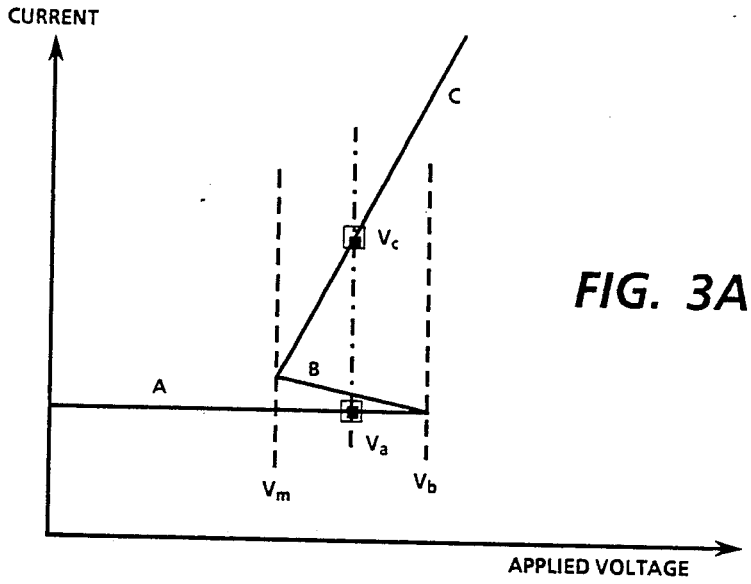
FIGS. 3A and 3B are graphs of the characteristic I-V curves for a corotron and a distributed resistance corona generating device, respectively.
Figure 3B:
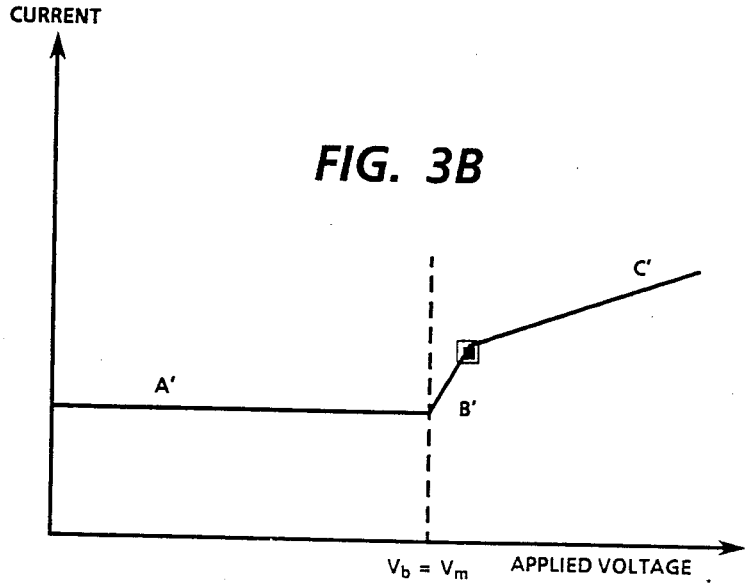

FIGS. 3A and 3B show an idealized comparison of the I-V operating characteristics of a gas discharge condition comparable to that produced by a wire coronode and the inventive distributed resistance corona generating devices. In FIG. 3A, $V_b$ is the breakdown voltage of a gas (air) and $V_m$ is the minimum sustainable operating voltage producing plasma current. No plasma current is produced for the voltages along line segment A to $V_b$. Segment B has a negative dynamic impedance, which is an unstable operating condition. Accordingly, stable operation, and production of plasma current can occur only along segment C. Looking at the curve, however, it can be seen that, at certain voltages, two conditions along the curve satisfy the function, one which produces plasma current while the other does not. Thus, for the same voltage between $V_m$ and $V_b$, simultaneously along the coronode may be points of corona or no corona, depending on the plasma current condition, as demonstrated at points $V_A$ and $V_C$.

In FIG. 3B, showing the operating characteristics of the distributed resistance corona generating devices, it can be seen that for any point along the curve, the function is satisfied by only one condition. The addition of the distributed resistance has shifted segment B′ from a negative slope or resistance to a positive resistance. Accordingly, the distributed resistance corona generating device is operable at any voltage greater than $V_m$, including the segment B′.

Figure 4:
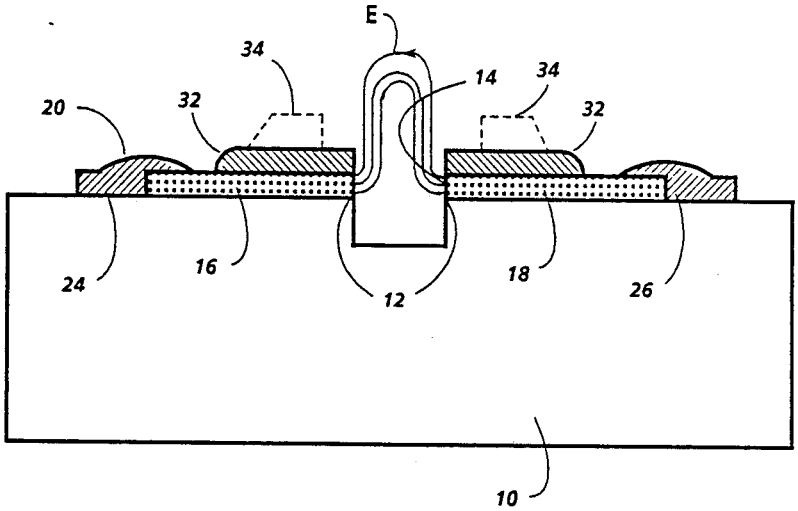
FIG. 4 is a cross sectional view of the distributed resistance corona generating device having an insulating overcoating.

In accordance with another aspect of the present invention, and as shown in FIG. 4, a dielectric overcoating 32 may be applied to exposed surface of the resistive coating, at the plasma gap 14. The electric field E generated at the plasma gap is usually directed, as demonstrated in FIG. 2, approximately from one exposed upper edge of the resistive material region towards the opposite exposed upper edge of the other resistive material region. Ions tend to flow along electric field lines, and have a tendency to return to the resistive material layer rather than flowing towards the surface to be charged. Providing a dielectric preventing the return of the ions to the upper surface of the resistive material regions as shown in FIG. 4 increases the numbers of ions available to flow to the surface to be charged. The dielectric overcoatings also serve as an insulating base for the support of auxiliary electrodes 34 (shown in phantom) which may be provided to improve control of the flow of ions towards the surface to be charged by providing an arrangement for modulation and deflection.

Figure 5A:
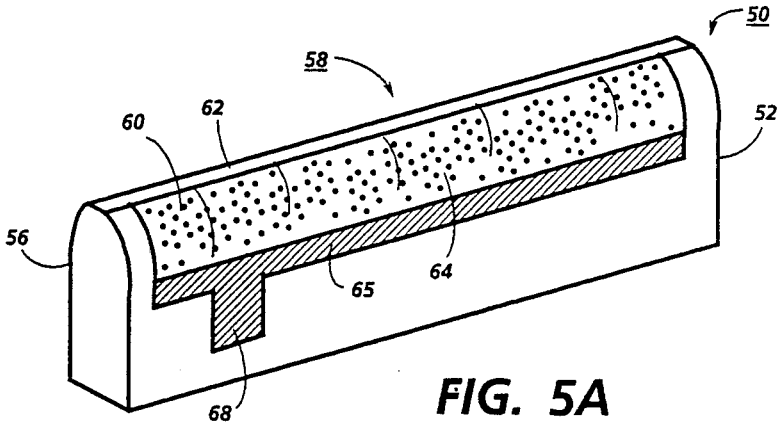
FIGS. 5A and 5B are, respectively, a perspective view of a knife edge or folded distributed resistance corona generating device and a cross sectional view of the the same device.
Figure 5B:
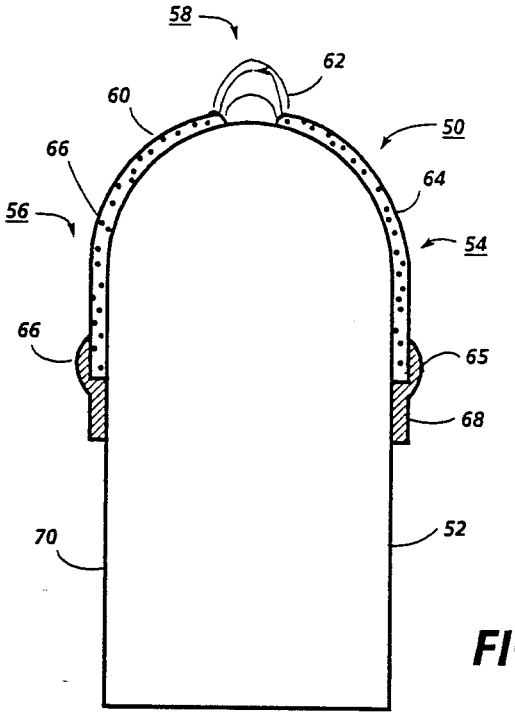

In accordance with another aspect of the invention, and with reference to FIGS. 5A and 5B, a folded or knife edge distributed resistance corona device 50 is provided with an insulating substrate 52 having first and second sides 54 and 56, and a connecting surface 58 joining the sides. Connecting surface 56 may advantageously form a continuous curve between first and second sides 54 and 56 to aid in the uniform deposition of the resistive material layer 60 over both sides of the substrate. A plasma gap 62 is provided on connecting surface 58 extending through the resistive material layer to form resistive material regions 64 and 66 coextensive with plasma gap 62, on either side 54 and 56 of the device 50. Conducting electrodes 65 and 66 extend along the length of each resistive material region, connected respectively through contact tabs 68 and 70 to the high and low potential side of a power supply (not shown) to uniformly provide a voltage signal to each point along the plasma gap. The advantage of the knife edge design, as shown in FIG. 5B is that the applied electric field E drawing ions away from the plasma gap is inherently enhanced by the topology of the arrangement. As described for the planar embodiment with an insulating overcoating, the direction of the electric field outwardly from the device increases the number of ions likely to move towards a surface to be charged.

Figure 6:
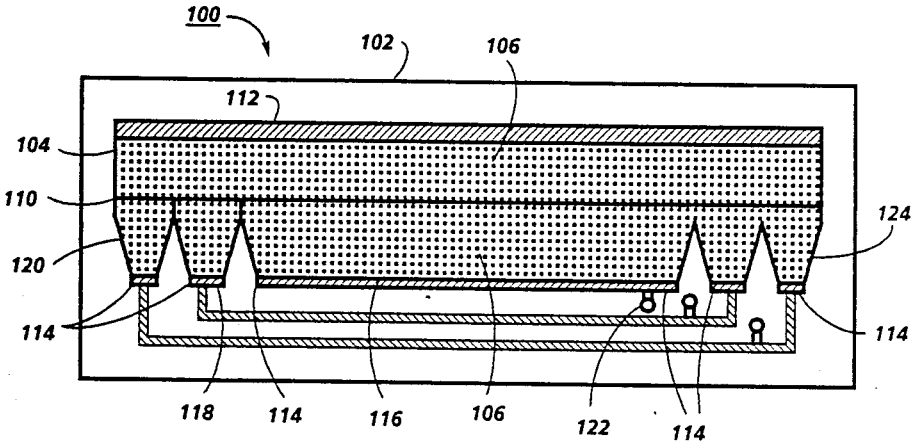
FIG. 6 is a plan view of a distributed resistance corona generating device having segmented resistive material regions.

In all the embodiments thus far described, it is an advantage of the device that it may be closely spaced to a surface to be charged, and in at least one embodiment the device may be spaced less than 25 mils from a surface to be charged. This close spacing of the corona device and the surface to be charged results in the charged areas defined very sharp boundaries, with little dissipation of the charging current outside the area most proximate to the device. To take advantage of this feature, and in accordance with yet another aspect of the invention, and with reference to FIG. 6, the novel distributed resistance corona device may be provided with differentially driven plasma gap portions, providing differing charging functions along the length of the gap. Distributed resistance device 100 is provided with an insulating substrate 102, having a uniform thickness resistive material layer 104 deposited thereon. The resistive material layer is divided into two regions 106 and 108 by a plasma gap 110 extending through the resistive material to the substrate. Resistive material region 108 is connected with an electrode 112 to a low potential side of a power supply (not shown), in a manner providing a uniform resistance between each point on the the plasma gap and the electrode. Resistive material region 106 is provided with a plurality of region segments 114, each segment electrically isolated from adjacent segments. Segments 114 are separately connected to power supplies which produce plasma at the plasma gap adjacent to each segment in accordance with control of the individual power supplies. The embodiment shown in FIG. 6 demonstrates an arrangement suitable for charging a charge retentive surface in accordance with the size to which a toner image will eventually be transferred. As may be seen in the embodiment, a central segment 116 is driven separately from edge segments 118, 120, 122, and 124, which may, for example, be driven or not driven in accordance with selected sheet size. In the described embodiment, end segments 118 and 120 may be paired with counterpart segments 122 and 124, respectively, on the opposite side of the central segment 116, to provide a non-charging condition at the sheet edges which eliminates the need for edge erase or interdocument lamps to dissipate charge in areas adjacent to image formation, by not charging these areas. The segments are driven to a plasma producing condition when larger size sheets require a greater proportion of the charge retentive surface to be charged. A reasonable extension of this arrangement would be to provide a larger number of segments selectively controlled to apply a charge to the surface in an annotation or printing scheme. In accordance with the annotation required, segments would be selectively driven to charge relatively small areas of the charge retentive surface. Assuming no dissipation of the charge in these areas by exposure to image radiation, these areas will be developed as an annotation or printing on the substrate.

If it is desired that corona not be developed at any selected area along the plasma gap, the resistive area adjacent that portion of the gap may be overcoated with a dielectric to the insulative substrate. Alternatively, the plasma gap may be widened at that point so that the threshold voltage is increased for that portion of the gap.

It will no doubt be appreciated that other arrangements are possible which achieve the desired result. It will additionally be appreciated that while the novel ion producing distributed resistance corona device has been described with respect to its function for applying a charge to a charge retentive surface, the device has equal applicability to charging functions throughout an electrostatographic device. The invention has utility to the standard functions in electrophotographic reproduction, including charging, transfer, detack and cleaning, and charge neutralization, as well as the less standard functions such as edge or interdocument erase and annotation. The invention also has applications to the production of ions of ionography and other reproduction and printing techniques where the production of ions is desired. The production of ions in an efficient and uniform manner also has applications to polymer industry for oxidation and polymerization, and to general chemical areas where the production of ions as chemical reactants are desirable. It is intended that all such variations and uses are included insofar as they come within the scope of the appended claims or equivalents thereof.

We claim:

1. A distributed resistance corona generating device for the production of ions, comprising:

a high voltage power supply;

an insulating substrate;

a highly resistive material layer uniformly deposited on said substrate, said resistive material layer separated into at least first and second resistive material regions by a plasma gap through said resistive material layer to said substrate;

a relatively highly conductive electrode associated with each said resistive material region for connection of said resistive material regions to said power supply to produce ions at said plasma gap;

said electrodes and said resistive material regions arranged to provide a uniform resistance through said resistive material layers between said electrodes and each point along said plasma gap.

2. A distributed resistance corona generating device as defined in claim 1, and including a dielectric material layer covering a portion of said resistive material layer adjacent said plasma gap.

3. A distributed resistance corona generating device as defined in claim 1, wherein said insulating substrate has first and second opposed sides and a connecting side joining said first and second sides; and said plasma gap through said resistive material layer to said substrate along said connecting side.

4. A distributed resistance corona generating device for the production of ions in an electrostatographic arrangement, comprising:

a high voltage power supply;

a generally planar insulating substrate member;

a highly resistive material layer uniformly deposited on said substrate, said resistive material layer separated into at least first and second resistive material regions by a plasma gap through said resistive material layer to said substrate, each said resistive material region coextensive with said plasma gap;

a relatively highly conductive electrode associated with each said resistive material region for connection thereof to said power supply to produce ions at said plasma gap, and arranged on said resistive material regions so that a uniform resistance is provided between said electrodes and each point on said resistive material regions immediately adjacent said plasma gap.

5. A distributed resistance corona generating device as defined in claim 4, and including a dielectric material layer covering a portion of said resistive material layer adjacent said plasma gap.

6. A distributed resistance corona generating device as defined in claim 5 and including a control electrode arranged on said dielectric material layer, electrically isolated from said resistive material layer, connectable to a controllable power source for controlling the flow of ions outwardly from said plasma gap.

7. A distributed resistance corona generating device as defined in claim 4, wherein said plasma gap has a width of approximately in the range of 0.5 to 20 mils.

8. A distributed resistance corona generating device as defined in claim 4, wherein said resistive material has a resistance of approximately 1–1000 megohms per square.

9. A distributed resistance corona generating device for the production of ions in an electrostatographic arrangement, comprising:

a high voltage power supply;

an insulating substrate having first and second opposed sides and a connecting side joining said first and second sides;

a highly resistive material layer uniformly deposited on each of said opposed sides of said substrate, said resistive material layer separated into at least first and second resistive material regions by a plasma gap through said resistive material layer to said substrate along said connecting side, each said resistive material region coextensive with said plasma gap; and an electrode associated with each said resistive material region for connection of said resistive material regions to said power supply for the production of ions at said plasma gap, and arranged thereon so that a uniform resistance value is provided between said electrodes and each point on said resistive material regions immediately adjacent said plasma gap.

10. A distributed resistance corona generating device as defined in claim 9, and including a dielectric material layer covering a portion of said resistive material layer adjacent said plasma gap.

11. A distributed resistance corona generating device for the production of ions in an electrostatographic arrangement, comprising:

a high voltage power supply;

an insulating substrate;

a highly resistive material layer uniformly deposited on said substrate, said resistive material layer separated into at least first and second separate resistive material regions by a plasma gap extending through said resistive material layer to said substrate;

at least said first resistive material region further divided into a plurality of separate charging segments, each charging segment contiguous to said plasma gap and electrically isolated from adjacent segments;

means for providing voltage potentials across said first and second resistive material regions, the potential across each of said separate charging segments controllable separately from an adjacent charging segment to produce ions at the plasma gap; and said resistive material layers providing a uniform resistance across each charging segment.

12. A distributed resistance corona generating device as defined in claim 11, wherein said first resistive material region is divided into a central charging segment and a plurality of side charging segments, each of said side charging segments having a corresponding side charging segment controllable identically therewith on the opposite side of said central charging segment, spaced an equal distance from the nearest edge thereof.

13. A distributed resistance corona generating device as defined in claim 11, and including a dielectric material layer covering a portion of said resistive material layer adjacent said plasma gap.

14. A charging arrangement for charging a surface in an electrostatographic arrangement, comprising:

a high voltage D.C. power supply;

an insulating substrate;

a highly resistive material layer uniformly deposited on said substrate, said resistive material layer separated into at least first and second separate resistive material regions by a plasma gap through said resistive material layer to said substrate;

a relatively highly conductive electrode associated with each said resistive material regions connecting said resistive material regions to said high voltage power supply to produce ions at said plasma gap; and said electrodes and said resistive material regions arranged to provide a uniform resistance through said resistive material layers between said electrodes and each point along said plasma gap.

15. A charging arrangement for charging a surface in an electrostatographic arrangement, as defined in claim 14, and including a dielectric material layer covering a portion of said resistive material layer adjacent said plasma gap.

16. A distributed resistance corona generating device as defined in claim 15 and including a control electrode arranged on said dielectric material layer, electrically isolated from said resistive material layer, connectable to a controllable power source for controlling the flow of ions outwardly from said plasma gap.

17. A charging arrangement for charging a surface in an electrostatographic arrangement as defined in claim 14, wherein said insulating substrate has first and second opposed sides and a connecting side joining said first and second sides; and said plasma gap through said resistive material layer to said substrate along said connecting side.

18. A charging arrangement for charging a surface in an electrostatographic arrangement as defined in claim 14, wherein said plasma gap has a width of approximately in the range of 0.5 to 20 mils.

19. A charging arrangement for charging a surface in an electrostatographic arrangement as defined in claim 14, wherein said resistive material has a resistance of approximately 1–1000 megohms per square.

20. A charging arrangement for charging a surface in an electrostatographic arrangement, comprising:

a high voltage D.C. power supply;

an insulating substrate;

a highly resistive material layer uniformly deposited on said substrate, said resistive material layer separated into at least first and second separate resistive material regions by a plasma gap extending through said resistive material layer to said substrate;

said first resistive material region further divided into a plurality of separate charging segments, each charging segment contiguous to said plasma gap and electrically isolated from adjacent segments said resistive material layer providing a uniform resistance across each charging segment; and relatively highly conductive electrodes associated with said second resistive material region and each of said separate charging segments, for connection of said resistive material region and said separate charging segments to a power supply, each of said separate charging segments controllable separately from an adjacent charging segment wherein said first resistive material region is further divided into a plurality of separate charging segments, each charging segment contiguous to said plasma gap and electrically isolated from adjacent segments, each said charging segments connected to an electrode and controllable separately from an adjacent charging segment to produce ions at the plasma gap.

* * * * *